US005421483A

United States Patent [19]

Parise

[11] Patent Number: 5,421,483

[45] Date of Patent: Jun. 6, 1995

[54] CONTAINER FOR SUBSTANCES CONCENTRATED IN THE FORM OF POWDER OR A LIQUID TO BE PLACED IN SOLUTION WITHIN A RECEPTACLE AT THE TIME OF USE

[76] Inventor: Bernardino Parise, Via Mantegna, 6/4, Marostica (Vicenza), Italy

[21] Appl. No.: 161,657

[22] Filed: Dec. 2, 1993

[30] Foreign Application Priority Data

Dec. 9, 1992 [IT] Italy ..... VI92A0192

[51] Int. Cl.[6] ..... B67D 5/00

[52] U.S. Cl. ..... 222/82; 222/129; 222/383.1; 206/222

[58] Field of Search ..... 222/81, 82, 83, 87, 222/129, 135, 136, 145, 383, 161; 206/222

[56] References Cited

U.S. PATENT DOCUMENTS

| | | | |
|---|---|---|---|
| 3,080,094 | 3/1963 | Modderno | 222/82 |
| 3,255,924 | 6/1966 | Modderno | 222/136 X |
| 3,255,926 | 6/1966 | Modderno | 222/136 |
| 3,318,484 | 5/1967 | Modderno | 222/145 X |
| 3,355,238 | 11/1967 | Schwartzman | 222/129 X |
| 3,458,076 | 7/1969 | Babcock | 222/129 X |
| 3,613,955 | 10/1971 | Wetherell, Jr. | 222/87 X |
| 3,648,899 | 3/1972 | Lukesch et al. | 222/136 X |
| 3,655,096 | 4/1972 | Easter | 206/222 X |
| 3,891,125 | 6/1975 | Morane et al. | 222/129 |
| 4,613,061 | 9/1986 | Meuresch et al. | 222/82 |
| 4,757,916 | 7/1988 | Goncalves | 206/222 X |
| 5,060,791 | 10/1991 | Zulauf | 222/129 X |
| 5,273,189 | 12/1993 | Jouillat et al. | 222/129 X |

*Primary Examiner*—Gregory L. Huson
*Attorney, Agent, or Firm*—Bucknam and Archer

[57] ABSTRACT

A container for substances concentrated in the form of a powder or a liquid to be placed in solution within a receptacle at the time of use, may be used when placed corresponding to the upper mouthpiece of a bottle (8) which is provided in the upper part with an atomizer (10). When the ringnut (9) of the atomizer (10) is screwed on the upper mouth of the bottle (8), the substance contained in the interior of the container falls within the solvent (11) which is placed in the interior of the bottle, thus allowing to obtain the desired solution.

6 Claims, 3 Drawing Sheets

CONTAINER FOR SUBSTANCES CONCENTRATED IN THE FORM OF POWDER OR A LIQUID TO BE PLACED IN SOLUTION WITHIN A RECEPTACLE AT THE TIME OF USE

The present invention relates to a container for substances concentrated in the form of a powder or a liquid to be placed in solution within a receptacle at the time of use, according to the preamble of claim 1.

BACKGROUND OF THE INVENTION

It is known that occasionally it is necessary to keep concentrated substances, in general in the form of a liquid or a powder, which are dissolved in a solvent consisting generally of water only at the time of use. Typically this occurs, for instance in the domestic field to prepare fertilizin solutions, herbicides or similar solutions.

The fact that it is possible to place these substances in sealed containers permits first of all to be able to fill with the desired solution a bottle or a similar receptacle only when there is the actual necessity to use the solution. Further several substances mentioned hereinabove have a tendency to degrade gradually if they are placed in solution while they maintain essentially unaltered their quality for periods of time which are also extremely long if they are maintained in an essentially sealed container.

According to the prior art a container comprises a pair of essentially hollow members which have cylindrical symmetry, one of which is disposed within the other, and which are assembled with mechanical interference corresponding to two areas of different diameter. These members define internally in the space between them a sealed chamber in the shape of a cylindrical crown corresponding to their exact and reciprocal axial position. This container is particularly capable to be placed in a place corresponding to the upper mouth of a bottle.

There is provided the possibility of causing the internal member to slide axially with respect to the external member which on the contrary remains fixed with respect to the mouth mentioned hereinabove, an arrangement which may be easily achieved at the time the metal ring of an atomizer is screwed, which is capable to cause the solution in the bottle to exit. This determines the exit from the chamber mentioned hereinabove of the concentrated substance and consequently its fall in the bottle causing the substance to mix with the solvent which fills the latter.

In this manner, the individual using the bottle may limit himself to acquire the receptacle containing the liquid which is necessary, which presents extremely limited dimensions in view of the high concentration of the content because it is possible to apply in general the device to any bottle, any receptacle and similar devices.

It is also clear that in view of the small space occupied by a single container, it is very useful and simple for the individual using the container to acquire and to maintain a plurality of the containers, without mentioning that also for the industry which produces the concentrated substance, it is simpler to sell concentrated substances enclosed in a small container rather than selling the substance contained in bottles or similar devices of large dimensions.

The container described in the above mentioned patent does not offer, however, sufficient guaranty of the seal with respect to the exit of the substance between the two elements having cylindrical symmetry in view of the small size of the surfaces which interfere corresponding to the area of greater diameter.

SUMMARY OF THE INVENTION

An object of the present invention is to provide a container of the type described hereinabove which offers features of superior safety and functionality with respect to similar devices of a known type and in particular the device mentioned hereinabove.

This is achieved according to the invention by providing one of the members having cylindrical symmetry in such a manner that it presents in the lower part a bottom provided with an axial opening while the other member of cylindrical symmetry has a beaker shape with the bottom placed on the part opposite to the bottom of the other member. A further cylindrical element projects from the bottom of the second member towards the opening present in the first member, this third element having such a diameter that its passage within the opening is possible with such an interference that proper seal is maintained.

This further cylindrical element is provided on the exterior with a ribbing which is intended to interfere further along the border of the opening, thus determining substantial enlargement and burring corresponding to a well defined position also of the two members thus determining the opening of the container. It is further provided that the external surface of one of the cylindrical members interferes mechanically with the internal surface of the other cylindrical member thus guaranteeing in this manner the seal with respect to the exit of the material contained in the space between the two cylindrical elements.

This device guarantees absolutely in each case proper seal thus permitting to achieve the object mentioned hereinabove.

The invention also covers particular features as defined in the dependent claims thus making the device particularly simple and effective.

This and other features of the invention will be described hereinbelow in detail with reference to a particular embodiment which is shown herein by way of a non-limiting example with reference to the attached drawings of which FIG. 1 is a longitudinal cross-sectional view of the container of the present invention applied to a bottle provided in the upper part with an atomizer in the sealed position;

Figure 1:
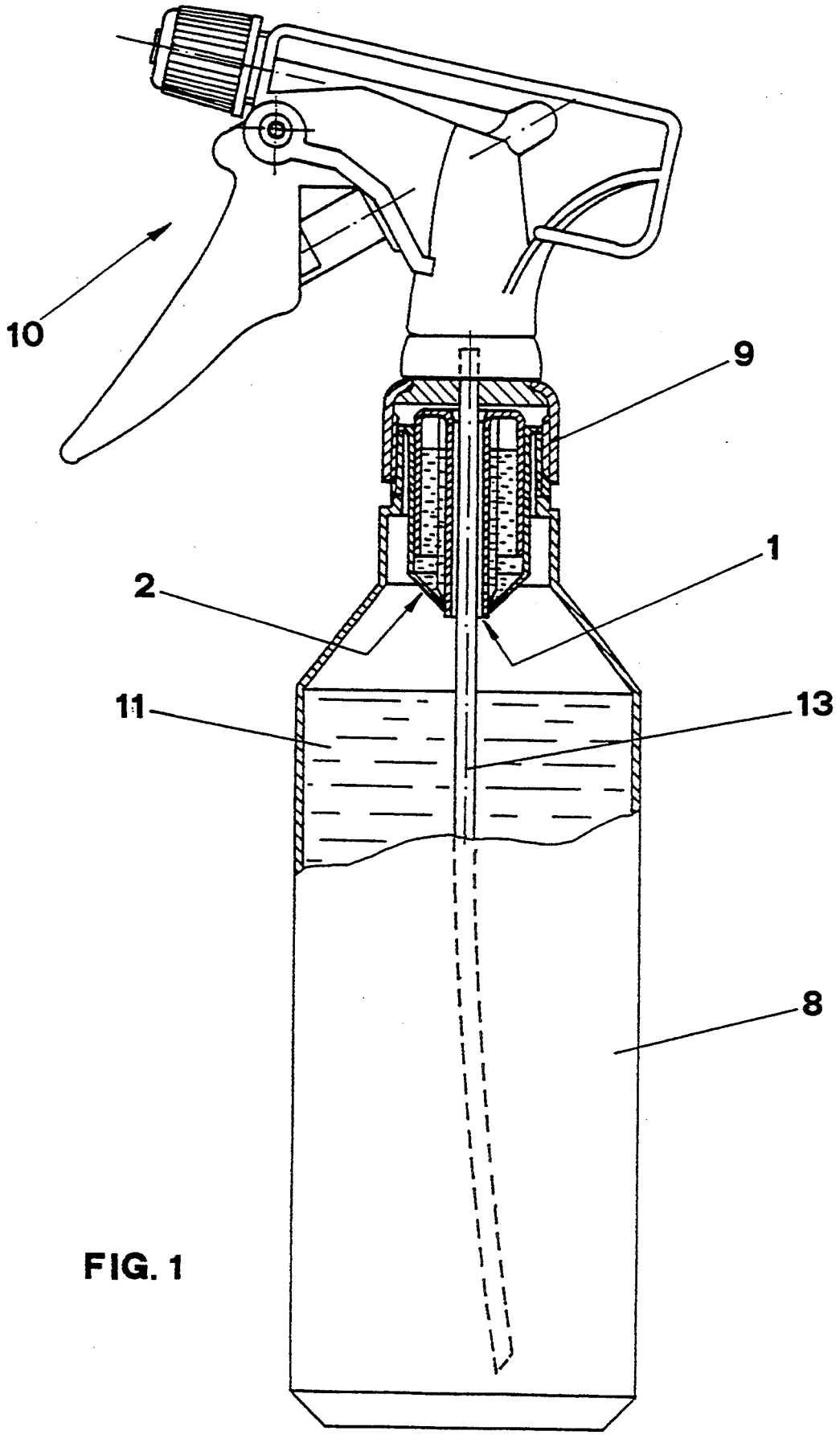

As shown in the attached figures, the container of the present invention comprises a pair of members 1 and 2 essentially of cylindrical shape. In particular, member 1 is capable of being inserted in the interior of member 2. The latter has corresponding to its lower part a bottom 3 in a funnel shape and in the central part of the bottom 3 there is provided an axial opening 4.

The other member 1 has the shape of a glass with a bottom 5 which is placed corresponding to the opposite part, that is the bottom of the other member 2. From this bottom 5 another cylindrical member 6 projects towards the opening 4 with the lower part 7 of such dimensions that it may go through the opening 4.

Figure 2:
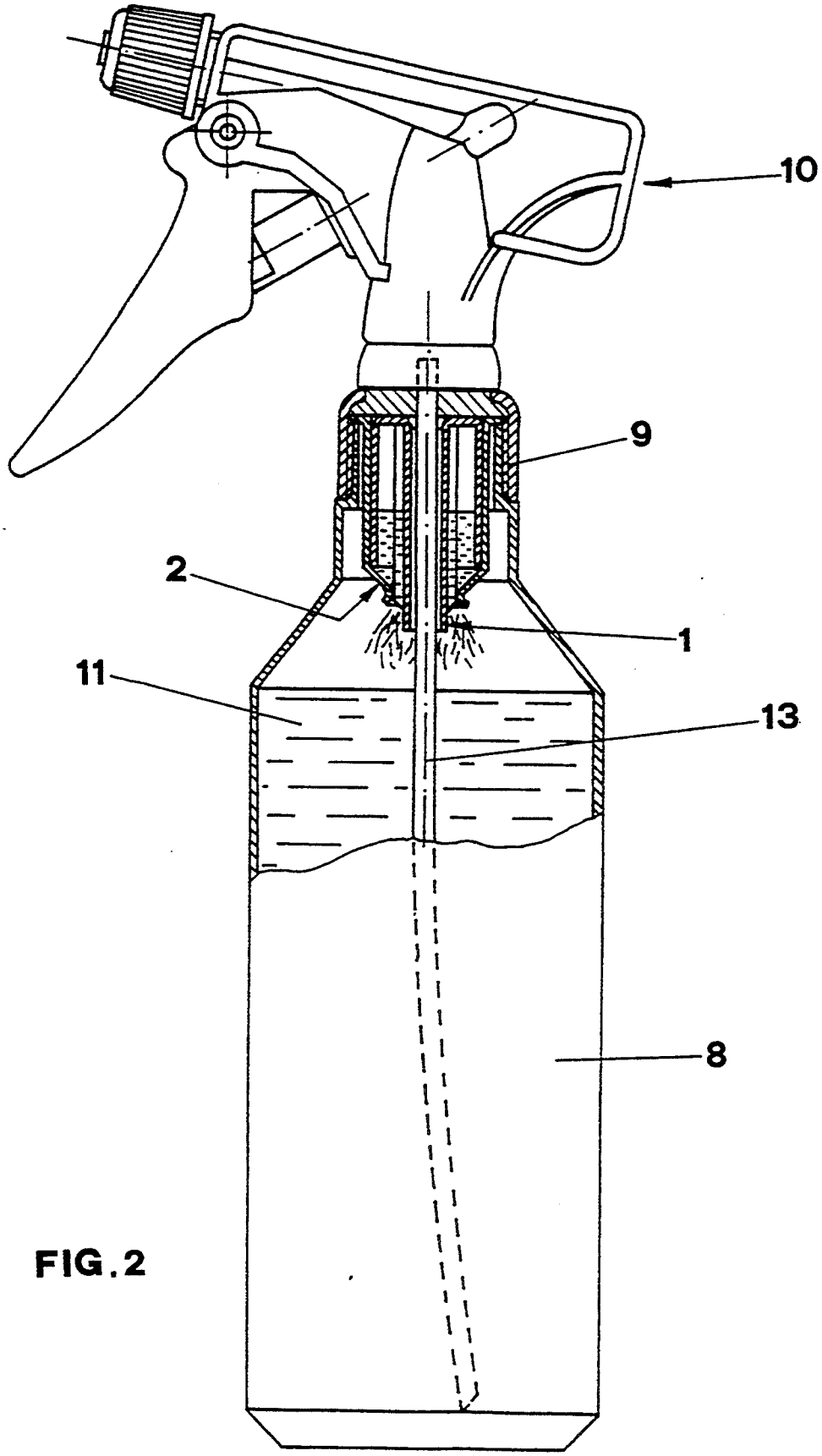
FIG. 2 is a view of the same container of FIG. 1 in a position such as to permit the exit from the interior of the substance being contained in the bottle.

As shown in FIGS. 1 and 2, in the space between the two members 1 and 2, there is placed a concentrated substance in the form of a powder or a liquid. The particular dimensions of the lower part 7 and the opening 4 permit to guarantee perfect sealing of the substance with respect to falling downwardly. Also the dimensions of the external surface of member 1 and the internal surface of member 2 guarantee good sealing with respect to preventing the exit of the substance upwardly.

The container may be placed, as shown in FIG. 1, by way of example, corresponding to the upper mouth of bottle 8 which contains a solvent, for instance water. In this case, the upper part of member 2 is shaped as a collar 14 which rests on the upper border of the mouthpiece.

FIG. 2 shows that when the ringnut 9 of atomizer 10 is screwed on the threaded mouthpiece of bottle 8, an opening of the container is created downwardly so that the substance contained in the interior falls in the interior of the solvent 11 which is contained in the bottle 8. This happens because corresponding to the external surface of the cylindrical member 6 there is provided ribbing 12 which is intended to interfere further with the border of the opening 4 so as to determine a substantial enlargement and consequently a burring corresponding to a well defined axial position.

Figure 3:
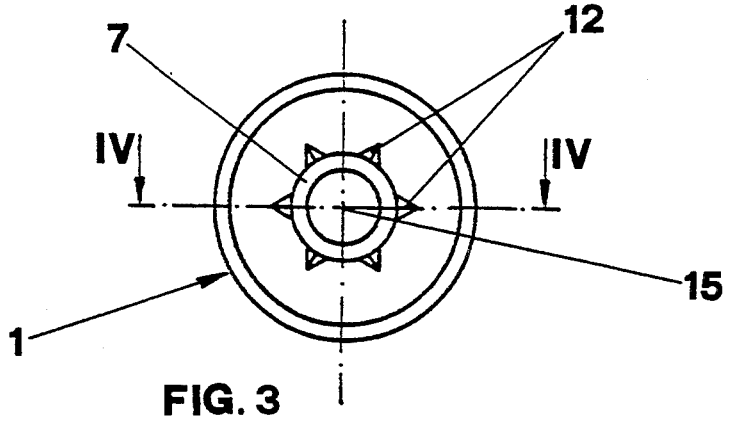
FIG. 3 is a plan view of one of the members of the cylindrical symmetry used in the device of the invention.
Figure 4:
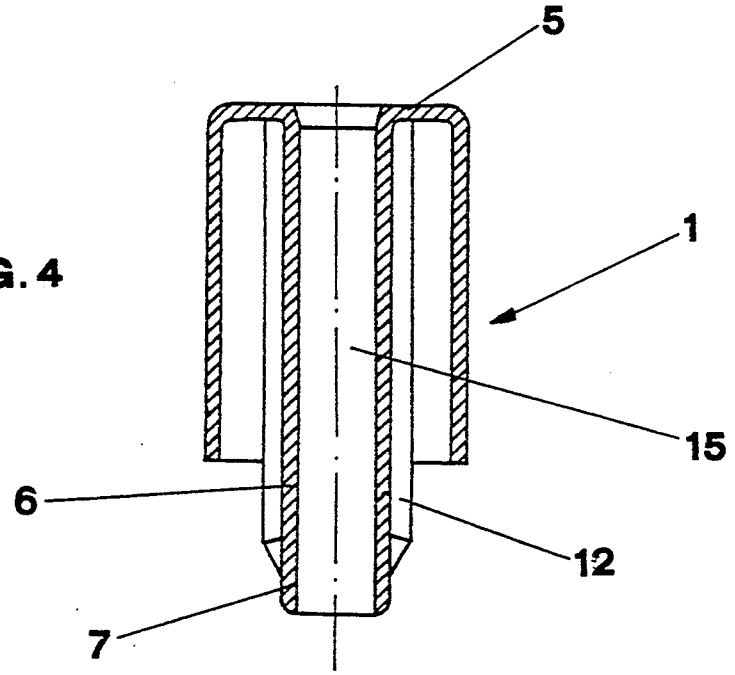
FIG. 4 & 5 illustrate a longitudinal cross-sectional view of one of the two members having cylindrical symmetry used in the device of the present invention.
Figure 5:
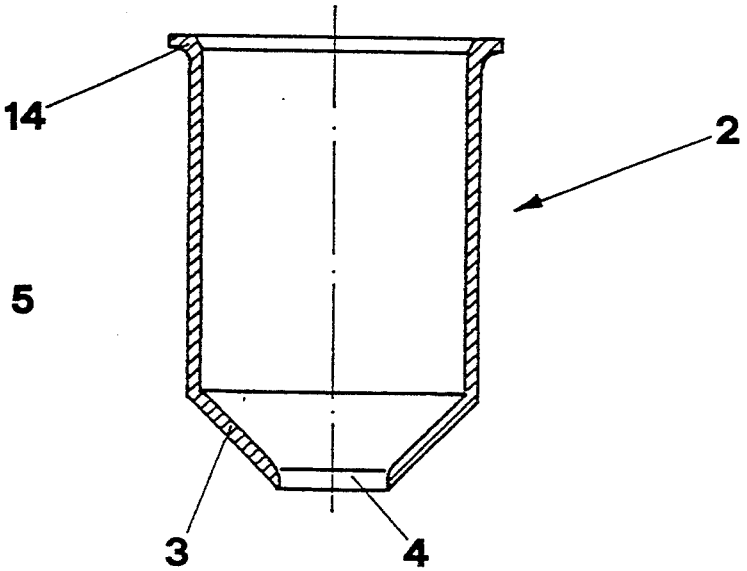

As shown particularly in FIGS. 3 and 4, advantageously there is provided a plurality of ribbings shaped as wedges and disposed angularly spaced at equal distance among themselves along the generatrices of member 6.

FIG. 3 particularly shows that in the interior of the cylindrical member 6 there is provided an axial channel 15 capable of permitting communication of the internal part of bottle 8 or any other container to which the container of the invention is applied with the exterior. In particular, this channel may permit the passage of a straw 13 used for the functioning of atomizer 10.

The container may also be applied to a bottle or similar device not provided with an atomizer. It is also possible that member 2 which has opening 4 have a diameter smaller with respect to the diameter of member 1 so that it may be placed in the interior of the latter. In any event, the two surfaces of reciprocal contact between the two members must interfere mechanically thus ensuring the sealing of the product which is placed in the space therebetween.

What is claimed is:

1. A container for substances concentrated in the form of a powder or a liquid to be placed in solution within a receptacle at the time of use, of the type which comprises a pair of members (1) and (2), said members being essentially hollow and having cylindrical symmetry, one of said members being disposed coaxially within the other, said members being assembled with mechanical interference corresponding to at least two areas of different diameter, said members defining internally in the space therebetween a sealed chamber having a cylindrical crown corresponding to their axially reciprocal positioning, characterized by the fact that a first member (2) is provided in the lower part thereof with a bottom (3), said bottom having opening (4) placed axially therein, the second member (1) having the shape of a glass, said glass having a bottom (5), said bottom (5) being placed on the part opposite with respect to the bottom of said first member (2), a third cylindrical member (6) projects from the bottom of said second member towards the opening provided in said first member, said third member (6) having a lower part (7) of such diameter that it may go through the passage within said opening (4) with such interference as to allow proper seal, said third cylindrical member being provided externally with at least one ribbing (12), said ribbing (12) interfering further with the border of said opening (4) and causing a substantial enlargement and burring corresponding to a well defined axial position of said first and second member, the external surface of one of said two first and second cylindrical members interfering mechanically with the internal surface of the other member thus ensuring proper seal.

2. The container according to claim 1, characterized by the fact that said first cylindrical element (2) which is provided in the bottom thereof (3) with said opening (4) contains in the interior thereof said second cylindrical element (1).

3. The container according to claim 1, characterized by the fact that said second cylindrical element (1) which has in the interior thereof said third cylindrical element (6) contains in the interior thereof said first cylindrical member (2).

4. The container according to claim 1, characterized by the fact that said third cylindrical member (6) which projects from said second cylindrical element (1) has in the interior thereof an axial opening (15).

5. The container according to claim 1, characterized by the fact that it is provided with at least one ribbing (12) shaped as a wedge disposed along one of the generatrices of said third member (6).

6. The container according to claim 5, characterized by the fact that it is provided with a plurality of ribbings (12) spaced at equal distance among themselves along the surface of said cylindrical member (6).

* * * * *